US008522515B2

(12) United States Patent
Carter et al.

(10) Patent No.: US 8,522,515 B2
(45) Date of Patent: Sep. 3, 2013

(54) METHOD AND APPARATUS FOR CUSTOMIZING CIGARETTE PACKAGES

(75) Inventors: Brent Walker Carter, High Point, NC (US); John Larkin Nelson, Lewisville, NC (US); Rebecca Anne Rogers, Pinnacle, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 385 days.

(21) Appl. No.: 12/359,843

(22) Filed: Jan. 26, 2009

(65) Prior Publication Data

US 2010/0186351 A1 Jul. 29, 2010

(51) Int. Cl.
*B65B 61/26* (2006.01)
*B65B 35/24* (2006.01)

(52) U.S. Cl.
USPC ..... 53/411; 53/131.2; 53/148; 53/446

(58) Field of Classification Search
USPC ..... 53/131.2, 135.1, 135.2, 136.1, 148, 53/411, 444, 446; 101/35
See application file for complete search history.

(56) References Cited

U.S. PATENT DOCUMENTS

| | | | | |
|---|---|---|---|---|
| 3,288,147 | A | 11/1966 | Molins et al. | |
| 3,424,172 | A | 1/1969 | Neurath et al. | |
| 3,577,919 | A * | 5/1971 | Usko | 198/617 |
| 3,596,663 | A | 8/1971 | Schultz et al. | |
| 3,885,522 | A * | 5/1975 | MacDonald et al. | 118/406 |
| 3,915,176 | A | 10/1975 | Heitmann et al. | |
| 4,174,719 | A | 11/1979 | Martin et al. | |
| 4,281,671 | A | 8/1981 | Byrne et al. | |
| 4,291,713 | A | 9/1981 | Frank | |
| 4,294,353 | A | 10/1981 | Focke et al. | |
| 4,330,976 | A * | 5/1982 | Blackall et al. | 53/151 |
| 4,474,190 | A | 10/1984 | Brand | |
| 4,508,525 | A | 4/1985 | Berger | |
| 4,534,463 | A | 8/1985 | Bouchard | |
| 4,574,816 | A | 3/1986 | Rudszinat | |
| 4,646,763 | A | 3/1987 | Nichols | |
| 4,655,736 | A | 4/1987 | Keith | |
| 4,715,497 | A | 12/1987 | Focke et al. | |
| 4,726,385 | A | 2/1988 | Chumney, Jr. | |
| 4,736,754 | A | 4/1988 | Heitmann et al. | |

(Continued)

FOREIGN PATENT DOCUMENTS

| | | | |
|---|---|---|---|
| DE | 102 38 906 | A1 | 3/2004 |
| GB | 1 042 000 | | 9/1966 |
| WO | WO 2005/113386 | A1 | 12/2005 |
| WO | WO 2006/064371 | A1 | 6/2006 |

OTHER PUBLICATIONS

Davis et al., *Tobacco Production, Chemistry and Technology*, 1999, pp. 440-460, Blackwell Science, Inc., Malden, MA.

*Primary Examiner* — Hemant M Desai
*Assistant Examiner* — Gloria R Weeks
(74) *Attorney, Agent, or Firm* — Womble Carlyle Sandridge & Rice, LLP

(57) ABSTRACT

An apparatus for customizing a cigarette package is provided, wherein the cigarette package is configured to receive a plurality of as-formed cigarettes therein. Such an apparatus comprises a feeder unit configured to feed one of a plurality of cigarette packages to a register position. An imprinting unit is configured to interact with the cigarette package in the register position so as to imprint at least one of an alphanumeric character and a graphical character thereon. An associated method is also provided.

21 Claims, 6 Drawing Sheets

(56) References Cited

U.S. PATENT DOCUMENTS

| | | | | | |
|---|---|---|---|---|---|
| 4,781,203 | A | | 11/1988 | La Hue | |
| 4,807,809 | A | | 2/1989 | Pryor et al. | |
| 4,811,745 | A | | 3/1989 | Cohen et al. | |
| 4,844,100 | A | | 7/1989 | Holznagel | |
| 4,852,734 | A | | 8/1989 | Allen et al. | |
| 4,862,905 | A | | 9/1989 | Green, Jr. et al. | |
| 4,878,506 | A | | 11/1989 | Pinck et al. | |
| 4,898,187 | A | * | 2/1990 | Hinchcliffe et al. | 131/284 |
| 4,925,602 | A | | 5/1990 | Hill et al. | |
| 5,012,823 | A | | 5/1991 | Keritsis et al. | |
| 5,025,814 | A | | 6/1991 | Raker | |
| 5,060,664 | A | | 10/1991 | Siems et al. | |
| 5,060,665 | A | | 10/1991 | Heitmann | |
| 5,101,839 | A | | 4/1992 | Jakob et al. | |
| 5,139,140 | A | | 8/1992 | Burrows et al. | |
| 5,156,169 | A | | 10/1992 | Holmes et al. | |
| 5,159,944 | A | | 11/1992 | Arzonico et al. | |
| 5,191,906 | A | | 3/1993 | Myracle, Jr. | |
| 5,220,930 | A | | 6/1993 | Gentry | |
| 5,225,277 | A | | 7/1993 | Takegawa et al. | |
| 5,249,416 | A | * | 10/1993 | Adams et al. | 53/463 |
| 5,271,419 | A | | 12/1993 | Arzonico et al. | |
| 5,333,729 | A | | 8/1994 | Wolfe | |
| 5,387,285 | A | | 2/1995 | Rivers | |
| 5,651,308 | A | * | 7/1997 | Rohwetter et al. | 101/40.1 |
| 5,938,018 | A | | 8/1999 | Keaveney et al. | |
| 5,970,682 | A | * | 10/1999 | Focke et al. | 53/53 |
| 6,138,437 | A | * | 10/2000 | Focke et al. | 53/133.7 |
| 6,244,017 | B1 | * | 6/2001 | Focke et al. | 53/147 |
| 6,283,022 | B1 | * | 9/2001 | Kamen et al. | 101/129 |
| 6,360,751 | B1 | | 3/2002 | Fagg et al. | |
| 6,537,186 | B1 | | 3/2003 | Veluz | |
| 6,647,878 | B2 | | 11/2003 | Blau et al. | |
| 6,726,006 | B1 | | 4/2004 | Funderburk et al. | |
| 6,736,261 | B1 | | 5/2004 | Thomas et al. | |
| 6,779,530 | B2 | | 8/2004 | Kraker | |
| 6,848,449 | B2 | | 2/2005 | Kitao et al. | |
| 6,857,358 | B2 | * | 2/2005 | Dittrich et al. | 101/35 |
| 6,904,917 | B2 | | 6/2005 | Kitao et al. | |
| 7,074,170 | B2 | | 7/2006 | Lanier, Jr. et al. | |
| 7,325,382 | B2 | | 2/2008 | Nelson et al. | |
| 2003/0136419 | A1 | | 7/2003 | Muller | |
| 2003/0145866 | A1 | | 8/2003 | Hartman | |
| 2004/0129281 | A1 | | 7/2004 | Hancock et al. | |
| 2004/0217023 | A1 | | 11/2004 | Fagg et al. | |
| 2004/0255800 | A1 | * | 12/2004 | Draghetti et al. | 101/35 |
| 2004/0256253 | A1 | | 12/2004 | Henson et al. | |
| 2005/0016556 | A1 | | 1/2005 | Ashcraft et al. | |
| 2005/0039764 | A1 | | 2/2005 | Barnes et al. | |
| 2005/0066986 | A1 | | 3/2005 | Nestor et al. | |
| 2005/0076929 | A1 | | 4/2005 | Fitzgerald et al. | |
| 2005/0150786 | A1 | | 7/2005 | Mitten et al. | |
| 2006/0011504 | A1 | * | 1/2006 | Gosebruch et al. | 206/459.5 |
| 2006/0243611 | A1 | | 11/2006 | Wu | |
| 2006/0272293 | A1 | * | 12/2006 | Nelson et al. | 53/444 |
| 2006/0272654 | A1 | * | 12/2006 | Barnes et al. | 131/70 |
| 2006/0272655 | A1 | | 12/2006 | Thomas et al. | |
| 2007/0006888 | A1 | * | 1/2007 | Hicks et al. | 131/70 |
| 2007/0051381 | A1 | * | 3/2007 | Hancock et al. | 131/284 |
| 2007/0056600 | A1 | | 3/2007 | Coleman, III et al. | |
| 2007/0215167 | A1 | | 9/2007 | Llewellyn Crooks et al. | |
| 2007/0246055 | A1 | | 10/2007 | Oglesby | |
| 2008/0093234 | A1 | | 4/2008 | Jones et al. | |
| 2008/0099353 | A1 | | 5/2008 | Parsons et al. | |
| 2008/0202540 | A1 | | 8/2008 | Carter et al. | |
| 2009/0038630 | A1 | * | 2/2009 | Bertuzzi et al. | 131/283 |

* cited by examiner

METHOD AND APPARATUS FOR CUSTOMIZING CIGARETTE PACKAGES

BACKGROUND OF THE INVENTION

1. Field of the Invention

Aspects of the present invention are directed to smoking articles such as cigarettes and, more particularly, to an apparatus and associated method for customizing cigarette packages configured to contain as-formed cigarettes.

2. Description of Related Art

Popular smoking articles, such as cigarettes, have a substantially cylindrical rod shaped structure and include a charge, roll, or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments, and one of those segments can comprise activated charcoal particles. See, for example, U.S. Pat. No. 6,537,186 to Veluz; PCT Publication No. WO 2006/064371 to Banerjea; and U.S. patent application Ser. No. 11/226,932, filed Sep. 14, 2005, to Coleman III, et al; each of which is incorporated herein by reference. Typically, the filter element is attached to one end of the tobacco rod using a circumscribing wrapping material known as "tipping paper," in order to provide a so-called "filtered cigarette." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999). A cigarette is employed by a smoker by lighting one end thereof and burning the tobacco rod. The smoker then receives mainstream smoke into his/her mouth by drawing on the opposite end (e.g., the filter or mouth end) of the cigarette.

Various attempts to alter the visual attributes of cigarettes have been proposed. For example, there have been attempts to alter the color of the wrapping materials that provide the wrapping material of the tobacco rod (e.g., cigarettes marketed under the trade name "More" by R. J. Reynolds Tobacco Company possess cigarette rod wrapping papers exhibiting a brown color) and tipping materials used to attach the tobacco rod to the filter element (e.g., tipping materials have been printed or otherwise formed so as to possess a "cork" appearance and/or to possess at least one circumscribing ring). In addition, there have been attempts to alter the general appearance of the filter elements of cigarettes. See, for example, the types of cigarette filter element formats, configurations and designs set forth in U.S. Pat. No. 3,596,663 to Schultz; U.S. Pat. No. 4,508,525 to Berger; U.S. Pat. No. 4,646,763 to Nichols; U.S. Pat. No. 4,655,736 to Keith; U.S. Pat. No. 4,726,385 to Chumney, Jr.; U.S. Pat. No. 4,807,809 to Pryor et al.; and U.S. Pat. No. 5,025,814 to Raker; and U.S. patent application Ser. No. 11/377,630, filed Mar. 16, 2006, to Crooks et al.; each of which is incorporated herein by reference.

In any instance, as-formed cigarettes may be typically provided to a cigarette packaging device, where the as-formed cigarettes are loaded into a package or otherwise suitable container. In this regard, manufacturing and packaging of relatively small quantities, lots, or batches of finished cigarettes having consistent quality can be provided in an automated fashion. Representative cigarette packages are of the types that traditionally have been employed for the commercial distribution and sale of smoking articles, such as cigarettes. See also, for example, the types of cigarette package configurations and packaging materials set forth in U.S. Pat. No. 4,294,353 to Focke et al.; U.S. Pat. No. 4,534,463 to Bouchard; U.S. Pat. No. 4,715,497 to Focke et al.; U.S. Pat. No. 4,852,734 to Allen et al.; U.S. Pat. No. 5,139,140 to Burrows et al.; U.S. Pat. No. 5,333,729 to Wolfe; U.S. Pat. No. 5,938,018 to Keaveney et al.; U.S. Pat. No. 6,726,006 to Funderburk et al.; U.S. Pat. No. 6,736,261 to Thomas et al. and U.S. Pat. No. 7,325,382 to Nelson et al.; PCT WO 2005/113386 to Buse; UK Pat. Spec. 1,042,000; German Pat. App. DE 10238906 to Marx; and US Pat. Applic. Nos. 2004/0217023 to Fagg et al.; 2004/0256253 to Henson et al.; 2005/0150786 to Mitten et al.; 2006/0243611 to Wu; 2008/0093234 to Jones et al. and 2008/0099353 to Parsons et al. Such packaging may typically include indicia thereon for providing information related to the cigarette brand, manufacturer, etc. However, current cigarette packaging is typically pre-printed or otherwise printed during pre-sale production with such standard information, and thus opportunities to customize the packaging to suit the needs (e.g., advertising) of a particular seller, buyer, or other interested party may not be readily available.

In this regard, it would be desirable to provide a consumer with the ability to selectively customize a cigarette package to have a particular appearance and/or design features. That is, it would be desirable to allow a customer to alter a cigarette package in a manner such that the visual appearance of the cigarette package is in accordance with the customer's preferences. It also would be desirable to provide a cigarette package having one or more particular aspects that can be readily modified or otherwise customized in a selective manner. Thus, there exists a need for a system and method for selectively customizing cigarette packages. Such a solution should desirably involve minimal equipment, should be relatively simple and cost effective; should be portable, if necessary; should not require extensive set up and testing procedures; should facilitate maintenance thereof, and should provide ready access to the cigarette packages being processed thereby.

BRIEF SUMMARY OF THE INVENTION

The above and other needs are met by aspects of the present invention which, in one instance, provides an apparatus for customizing a cigarette package, wherein the cigarette package is configured to receive a plurality of as-formed cigarettes therein. Such an apparatus comprises a feeder unit configured to feed one of a plurality of cigarette packages to a register position. An imprinting unit is configured to interact with the cigarette package in the register position so as to selectively imprint at least one of an alphanumeric character and a graphical character thereon.

Another aspect of the present invention is directed to a method of customizing a cigarette package, wherein the cigarette package is configured to receive a plurality of as-formed cigarettes therein. Such a method comprises feeding one of a plurality of cigarette packages to a register position using a feeder unit. At least one of an alphanumeric character and a graphical character is then selectively imprinted on the cigarette package, in the register position, using an imprinting unit.

Aspects of the present invention thus address the needs identified above and provide significant advantages as further discussed herein.

BRIEF DESCRIPTION OF THE SEVERAL VIEWS OF THE DRAWINGS

Figure 1:
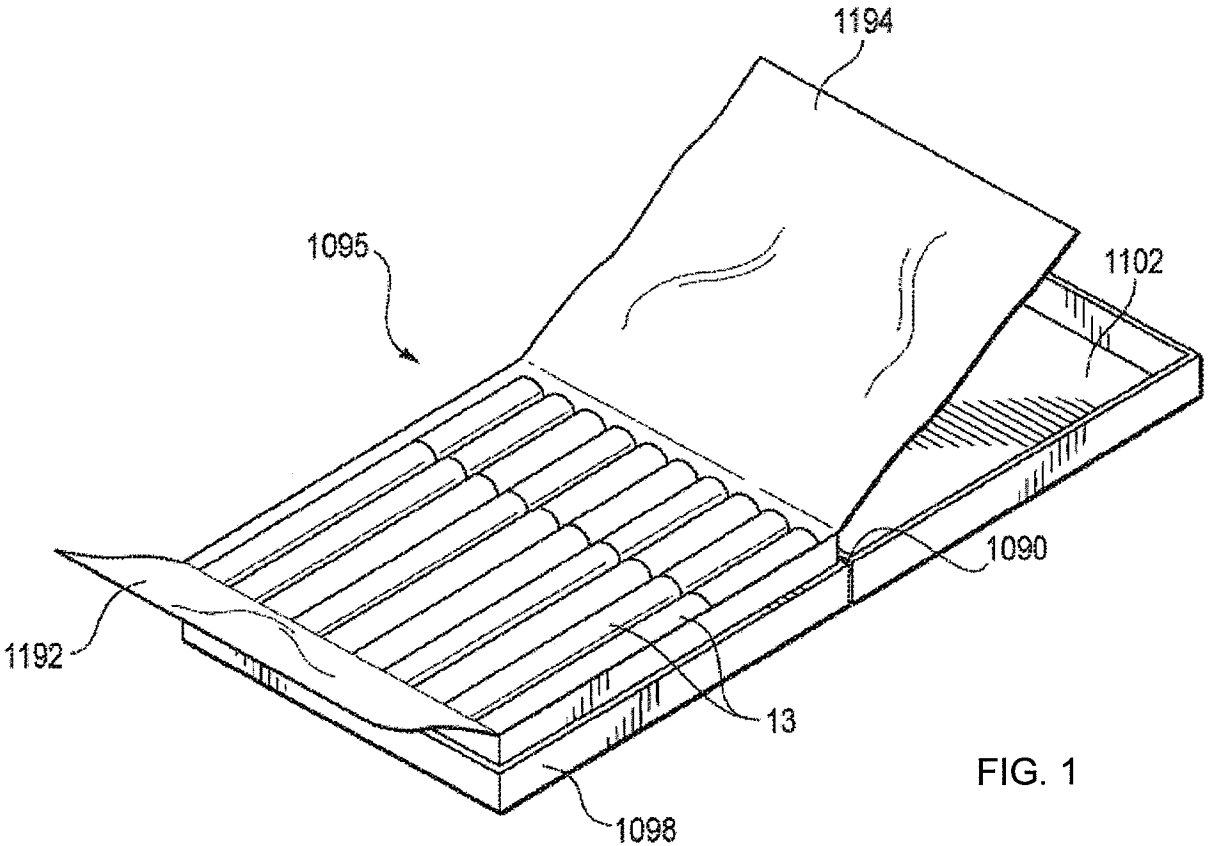
Figure 2:
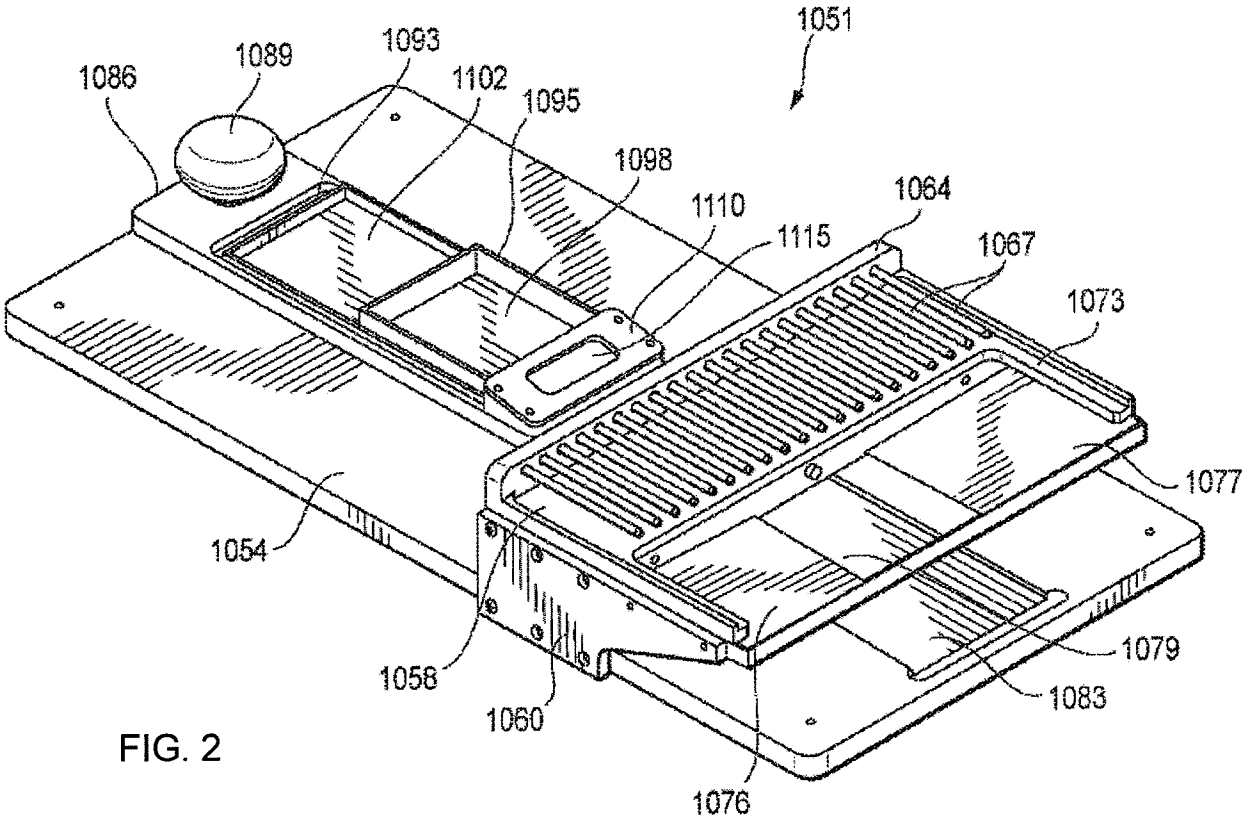
Figure 3:
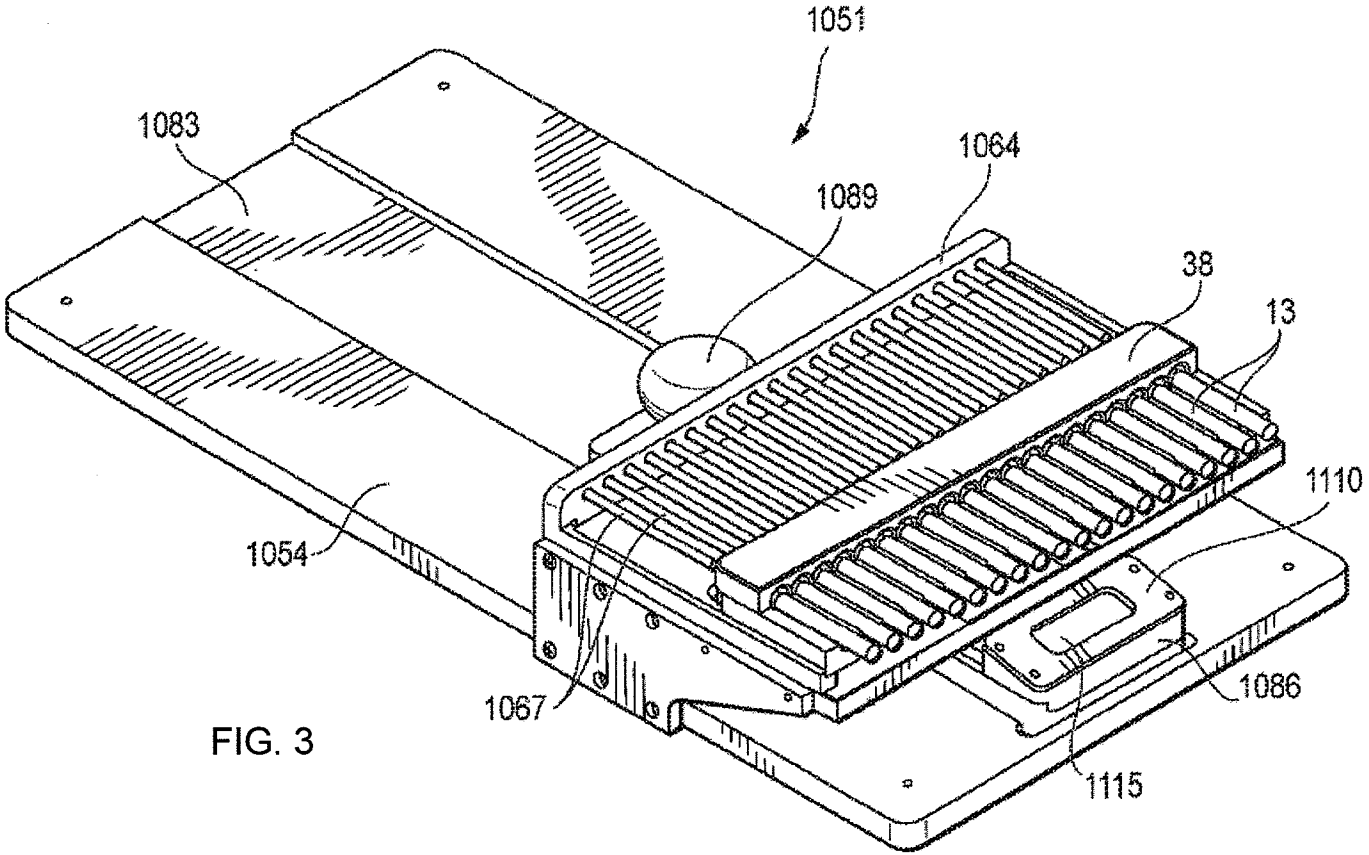
Figure 4:
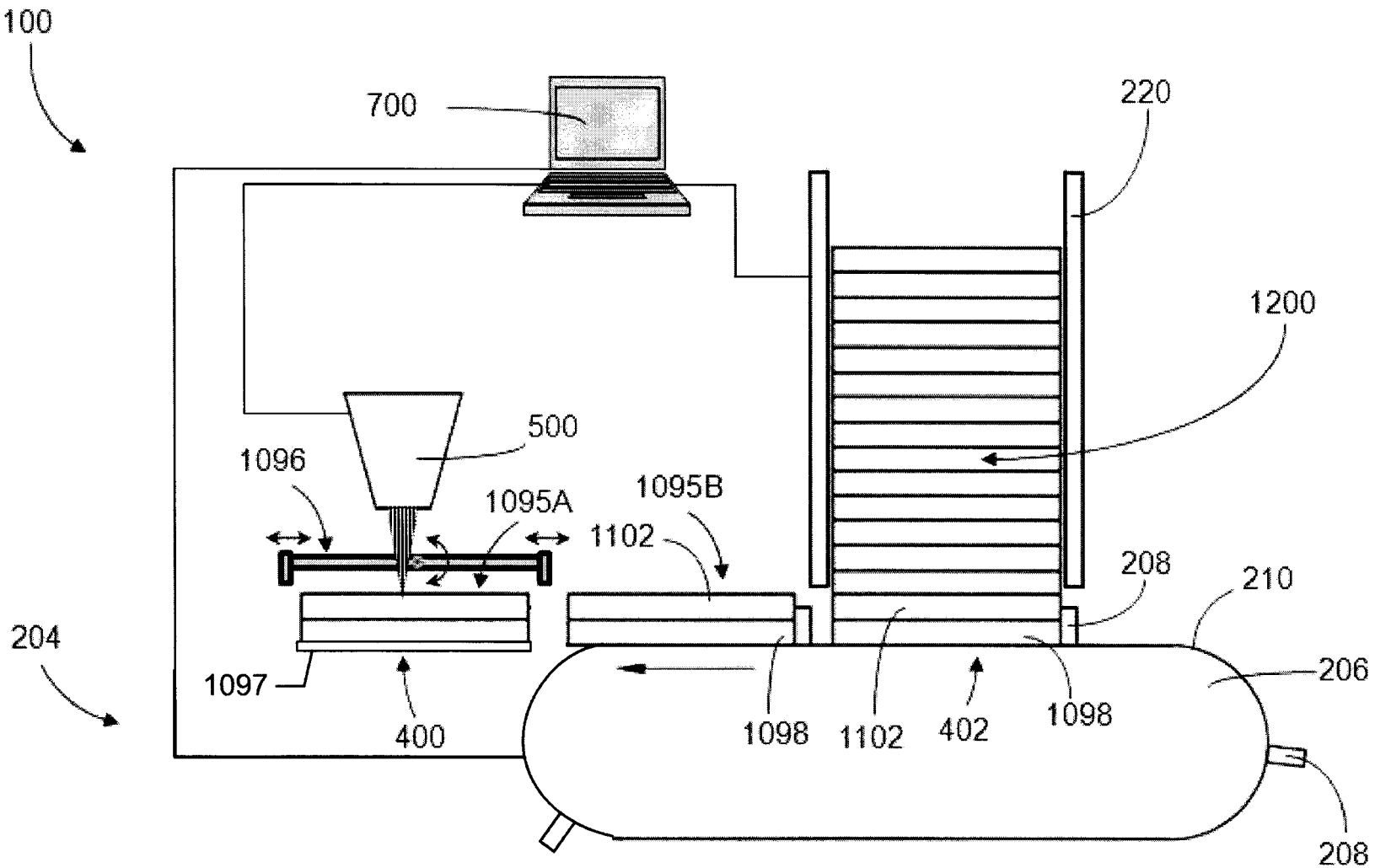
Figure 5:
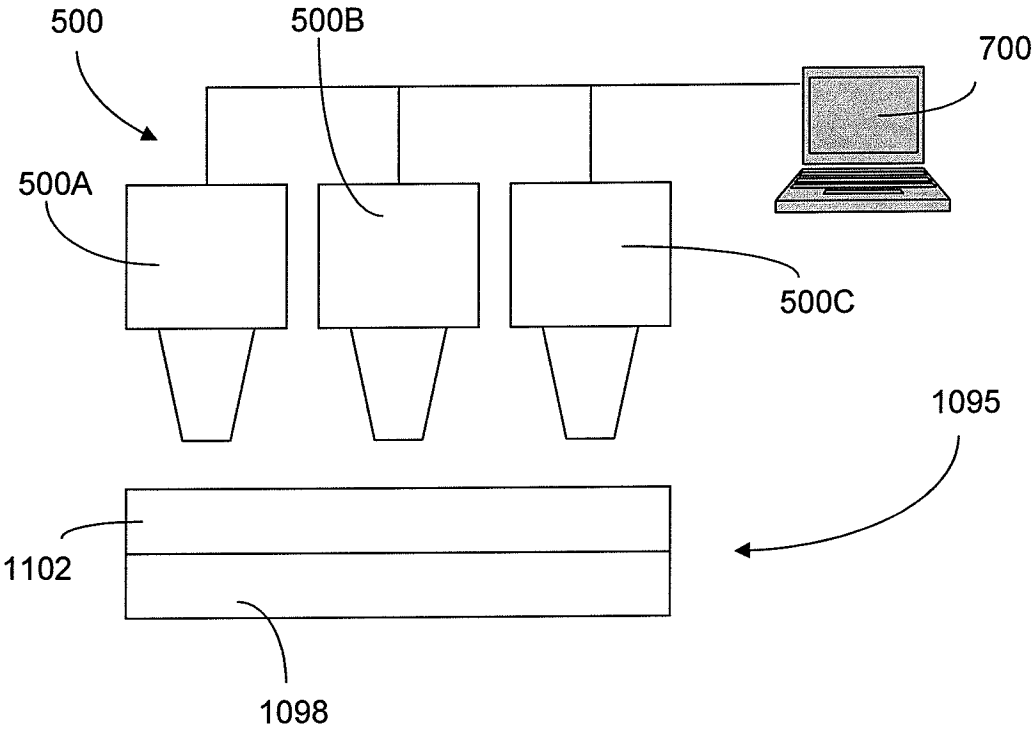
Figure 6:
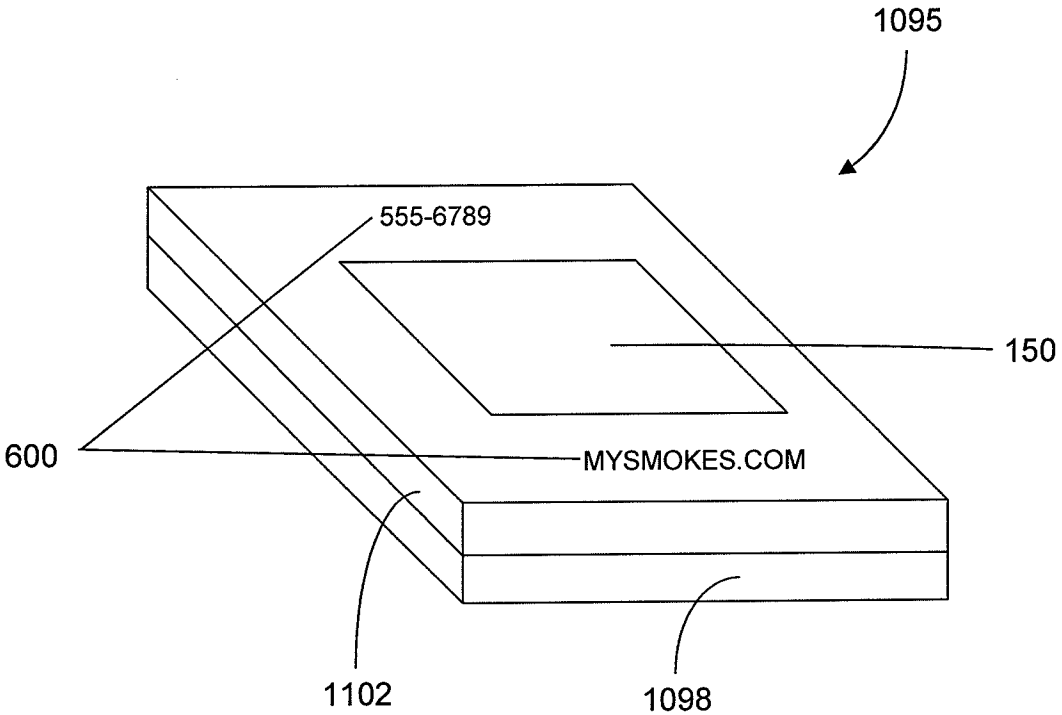

Having thus described the invention in general terms, reference will now be made to the accompanying drawings, which are not necessarily drawn to scale, and wherein:

FIG. 1 is a perspective view of a cigarette package capable of being customized in accordance with various embodiments of the present invention;

FIGS. 2 and 3 are perspective views of an apparatus for filling a cigarette package with manufactured as-formed cigarettes;

FIG. 4 is a schematic of a cigarette package customization apparatus according to one aspect of the present invention, implementing a successive feed system and method;

FIG. 5 is a schematic of a cigarette package customization apparatus according to an alternate aspect of the present invention, implementing an imprinting unit having a plurality of imprinting elements; and FIG. 6 illustrates an example of at least one of an alphanumeric character and a graphical character imprinted on a cigarette package using a cigarette package customization apparatus according to one aspect of the present invention.

DETAILED DESCRIPTION OF THE INVENTION

The present invention now will be described more fully hereinafter with reference to the accompanying drawings, in which some, but not all aspects of the inventions are shown. Indeed, these inventions may be embodied in many different forms and should not be construed as limited to the aspects set forth herein; rather, these aspects are provided so that this disclosure will satisfy applicable legal requirements. Like numbers refer to like elements throughout.

Cigarette rods may be manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,156,169 to Holmes et al.; U.S. Pat. No. 5,191,906 to Myracle, Jr. et al.; U.S. Pat. No. 6,647,878 to Blau et al.; U.S. Pat. No. 6,848,449 to Kitao et al.; and U.S. Pat. No. 6,904,917 to Kitao et al.; and U.S. Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and U.S. Patent Application Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Various types of cigarette components, including tobacco types, tobacco blends, top dressing and casing materials, blend packing densities and types of paper wrapping materials for tobacco rods, can be employed. See, for example, the various representative types of cigarette components, as well as the various cigarette designs, formats, configurations and characteristics, that are set forth in Johnson, Development of Cigarette Components to Meet Industry Needs, 52$^{nd}$ T.S.R.C. (September 1998); U.S. Pat. No. 5,101,839 to Jakob et al.; U.S. Pat. No. 5,159,944 to Arzonico et al.; U.S. Pat. No. 5,220,930 to Gentry and U.S. Pat. No. 6,779,530 to Kraker; U.S. Patent Publication Nos. 2005/0016556 to Ashcraft et al. and 2005/0066986 to Nestor et al; and U.S. patent application Ser. No. 11/375,700, filed Mar. 14, 2006, to Thomas et al. and U.S. patent Ser. No. 11/408,625, filed Apr. 21, 2006, to Oglesby; each of which is incorporated herein by reference. Most preferably, the entire smokable rod is composed of smokable material (e.g., tobacco cut filler) and a layer of circumscribing outer wrapping material.

Components for filter elements for filtered cigarettes typically are provided from filter rods that are produced using traditional types of rod-forming units, such as those available as KDF-2 and KDF-3E from Hauni-Werke Korber & Co. KG. Typically, filter material, such as filter tow, is provided using a tow processing unit. An exemplary tow processing unit has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating a filter material supply units and filter-making units are set forth in U.S. Pat. No. 4,281,671 to Byrne; U.S. Pat. No. 4,862,905 to Green, Jr. et al.; U.S. Pat. No. 5,060,664 to Siems et al.; U.S. Pat. No. 5,387,285 to Rivers; and U.S. Pat. No. 7,074,170 to Lanier, Jr. et al. Other types of technologies for supplying filter materials to a filter rod-forming unit are set forth in U.S. Pat. No. 4,807,809 to Pryor et al. and U.S. Pat. No. 5,025,814 to Raker; which are incorporated herein by reference.

The filter material can vary, and can be any material of the type that can be employed for providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary tow such as cellulose acetate, polyolefins such as polypropylene, or the like. One filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. No. 3,424,172 to Neurath; U.S. Pat. No. 4,811,745 to Cohen et al.; U.S. Pat.

No. 4,925,602 to Hill et al.; U.S. Pat. No. 5,225,277 to Takegawa et al. and U.S. Pat. No. 5,271,419 to Arzonico et al.; each of which is incorporated herein by reference.

Normally a plasticizer such as triacetin is applied to the filamentary tow in traditional amounts using known techniques. Other suitable materials or additives used in connection with the construction of the filter element will be readily apparent to those skilled in the art of cigarette filter design and manufacture. See, for example, U.S. Pat. No. 5,387,285 to Rivers.

The plug wrap can vary. See, for example, U.S. Pat. No. 4,174,719 to Martin. Typically, the plug wrap is a porous or non-porous paper material. Suitable plug wrap materials are commercially available. Exemplary plug wrap papers ranging in porosity from about 1,100 CORESTA units to about 26,000 CORESTA units are available from Schweitzer-Mauduit International as Porowrap 17-M1, 33-M1, 45-M1, 70-M9, 95-M9, 150-M4, 150-M9, 240M9S, 260-M4 and 260-M4T; and from Miquel-y-Costas as 22HP90 and 22HP150. Non-porous plug wrap materials typically exhibit porosities of less than about 40 CORESTA units, and often less than about 20 CORESTA units. Exemplary non-porous plug wrap papers are available from Olsany Facility (OP Paprina) of the Czech Republic as PW646; Wattenspapier of Austria as FY/33060; Miquel-y-Costas of Spain as 646; and Schweitzer-Mauduit International as MR650 and 180. Plug wrap paper can be coated, particularly on the surface that faces the filter material, with a layer of a film-forming material. Such a coating can be provided using a suitable polymeric film-forming agent (e.g., ethylcellulose, ethylcellulose mixed with calcium carbonate, nitrocellulose, nitrocellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA-20 and ZNA-25 from Treofan Germany GmbH & Co. KG can be employed as plug wrap materials.

Manners and methods for applying adhesives to tipping materials during automated cigarette manufacture will be apparent to those skilled in the art of cigarette design and manufacture. For example, a filtered cigarette can be tipped with a first layer of tipping material in an essentially traditional manner using a Lab MAX tipping device that is available from Hauni-Werke Korber & Co. KG, and that tipped cigarette can be collected and tipped again using that device (e.g., using the device in an essentially traditional manner, or in a suitably modified manner to provide a desired pattern of adhesive application) in order to provide a filtered cigarette possessing two layers of tipping material.

The tipping material that is used for any of the tipping material layers can vary. In certain preferred aspects, the material used to construct both tipping material layers has the characteristics and qualities commonly associated with cigarette tipping materials known in the art. As such, both layers can be constructed of the types of material conventionally used as tipping material in the manufacture of cigarettes. Typical tipping materials are papers exhibiting relatively high opacities. Representative tipping materials have TAPPI opacities of greater than about 81 percent, often in the range of about 84 percent to about 90 percent, and sometimes greater than about 90 percent. Typical tipping materials are printed with inks, typically nitrocellulose based, which can provide for a wide variety of appearances and "lip release" properties. Representative tipping papers materials have basis weights ranging from about 25 $m/m^2$ to about 60 $g/m^2$, often about 30 $g/m^2$ to about 40 $g/m^2$. Representative tipping papers are available as Tervakoski Reference Nos. 3121, 3124, TK 652, TK674, TK675, A360 and A362; and Schweitzer-Mauduit International Reference Nos. GSR270 and GSR265M2. See also, for example, the types of tipping materials, the methods for combining cigarette components using tipping materials, and techniques for wrapping various portions of cigarettes using tipping materials, that are set forth in U.S. patent application Ser. No. 11/377,630, filed Mar. 16, 2006, to Crooks et al.

Adhesives used to secure tipping materials to each other or to other filtered cigarette components can vary. Typical exemplary adhesive formulations that are used for application of tipping material to other cigarette components in commercial filtered cigarette manufacturing operations are water-based emulsions incorporating mixtures of ethylene vinyl acetate copolymers and polyvinylacetate. Representative adhesives that are useful for applying tipping materials to cigarette components are available as Reference Nos. 32-2049 and 32-2124 from National Starch & Adhesives Corp. See also, for example, Skeist, Handbook of Adhesives, $2^{nd}$ Edition (1977); Schneberger, Adhesive in Manufacturing (1983); Gutcho, Adhesives Technology Developments Since 1979 (1983); Landrock, Adhesives Technology Handbook (1985); and Flick, Handbook of Adhesives Raw Materials, $2^{nd}$ Edition (1989).

As-formed cigarettes may be loaded into an appropriately-sized cigarette packaging container. Representative types of cigarette packages suitable for use with the present invention include those of the types set forth in U.S. Pat. No. 4,294,353 to Focke et al.; U.S. Pat. No. 4,534,463 to Bouchard; U.S. Pat. No. 4,715,497 to Focke et al.; U.S. Pat. No. 4,852,734 to Allen et al.; U.S. Pat. No. 5,139,140 to Burrows et al.; U.S. Pat. No. 5,333,729 to Wolfe; U.S. Pat. No. 5,938,018 to Keaveney et al.; U.S. Pat. No. 6,726,006 to Funderburk et al.; U.S. Pat. No. 6,736,261 to Thomas et al. and U.S. Pat. No. 7,325,382 to Nelson et al.; PCT WO 2005/113386 to Buse; UK Pat. Spec. 1,042,000; German Pat. App. DE 10238906 to Marx; and US Pat. Applic. Nos. 2004/0217023 to Fagg et al.; 2004/0256253 to Henson et al.; 2005/0150786 to Mitten et al.; 2006/0243611 to Wu; 2008/0093234 to Jones et al. and 2008/0099353 to Parsons et al.

As shown in FIG. 1, a representative cigarette package 1095 may include a cigarette receptacle portion 1098 for holding cigarettes 13, and a cover portion 1102 associated therewith that is configured to close over the cigarette receptacle portion 1098 so as to maintain the cigarettes 13 within the package 1095. A representative cigarette receptacle portion 1098 has an inner depth of about 4 mm to about 6 mm; a length of about 19 cm; and a width of about 9 cm. The cigarette receptacle portion 1098 may have outer dimensions of about 8.2 cm wide, about 8.9 cm long and about 18 mm high (such dimensions being measured when the package 1095 is in a closed or sealed configuration). The illustrated package embodiment 1095 is of the type that has been referred to as a "shoulder box." The package 1095 is shown in an open position and is configured to contain twenty cigarettes. As illustrated, the cigarettes are aligned within the package in two rows of ten cigarettes, with one row positioned adjacent to the second row. The package 1095 preferably is manufactured from folded paperboard material, and can be of any type useful for the packaging of cigarettes. The package 1095 includes a generally rectilinear cover portion 1102 that opens with respect to the cigarette receptacle portion 1098 about a hinge 1090 that extends transversely across the engagement with the cigarette receptacle portion 1098. The cigarettes are contained in the cigarette receptacle portion 1098 of the box 1095. The cigarette receptacle portion

1098 may also hold a first foil flap 1192 and an opposing second foil flap 1194 that can cooperate to close over the cigarettes 13, or that can be opened to expose the cigarettes (as shown). Representative types of shoulder box packages have been commercially available, and the selection thereof is a matter of choice. If desired, the shoulder box and associated wrapping materials can be embossed, printed with indicia, or the like, particularly during pre-sale production. If desired, the package of cigarettes can be wrapped in a plastic or other film (e.g., a clear polypropylene film).

The cigarettes may be packaged using, for example, the equipment and materials described in U.S. Pat. No. 7,325,382 to Nelson et al., which is incorporated herein by reference in its entirety. That is, a cigarette packaging apparatus may be provided to insert the as-formed cigarettes into a cigarette packaging container such as, for example, the cigarette package 1095. Referring to FIG. 2, there is shown a schematic illustration of a representative package-filling device 1051 for filling the cigarette package 1095 with manufactured as-formed cigarettes. The apparatus 1051 includes a bottom frame 1054. A representative bottom frame is about 27.5 cm wide and about 56 cm long. A representative base may be manufactured from any suitable material, but preferably is manufactured from aluminum.

The bottom frame 1054 supports an upper platform 1058. The upper platform 1058 is suspended above the base by left and right side walls 1060. In a representative embodiment, the clearance between the upper face of the bottom frame and the lower surface of the upper platform 1058 is about 3 cm. A representative upper platform may be manufactured from any suitable material, but preferably is manufactured from aluminum.

The upper platform 1058 includes an upwardly extending ejection rod-supporting cross-member 1064 that extends thereacross. Extending generally horizontally forward from the cross-member 1064 is a plurality of ejection rods 1067. For the embodiment shown, the device includes twenty forwardly-extending ejection rods 1067, each with a substantially circular cross-section. A representative ejection rod has a length of about 7.2 cm and a diameter of about 4 mm and is manufactured from steel. The package-filling device 1051 preferably is adapted such that in a region forward of the ejection rods 1067, there a positioning platform region 1073 for a cartridge 38 filled with twenty cigarettes. It is highly preferred that the cigarettes within the cartridge are positioned on their sides (e.g., the longitudinal axis of each cigarette is parallel to, or substantially parallel to, the horizontal plane, and aligned with the longitudinal axis of the package-filling device 1051). The central portion of the positioning platform region 1073 includes a broad space open to the structures below, as is explained hereafter.

Below the front portion of the cartridge positioning platform region 1073 are an inwardly sloping left panel 1076 and an inwardly sloping right panel 1077 that define the sides of an open center region 1079. Representative sloping panels are manufactured from sheets of highly polished stainless steel. A representative open center region is generally rectangular with a width of about 8 cm and a length of about 9 cm.

The upper face of the bottom frame 1054 includes a broad groove 1083, channel, or other mechanism for providing for controlled movement of a carriage 1086 from the back of the base 1054 to the front of the device 1051. A representative groove has a vertical depth of about 4 mm to about 6 mm, a width of about 9 cm, and a length such that the groove extends to within about 1 cm of the front end of the device. The arrangement of the carriage 1086 and groove 1083 preferably are such that the carriage 1086 is easily movable within the groove 1083. Typically, selection of the respective shapes and dimensions of the carriage and the groove define the arrangement of the carriage in the groove. For example, the sides of the carriage and the sides of the groove may be designed so as to cooperate in a tongue-in-groove type of arrangement. The carriage 1086 includes an upwardly extending handle 1089, such that the carriage 1086 can be moved back and forth. Within a recess 1093 in the upper face of the carriage is positioned the cigarette package 1095 in an open position.

In operation, the apparatus 1051 preferably is positioned firmly in place on a table, bench, counter, or the like. Alternatively, the apparatus can be permanently affixed to components of a work station. Optionally, a pre-cut inner package wrapping paper, foil/paper laminate or paper-lined foil 1192 is placed into the package 1095. A typical foil sheet has a width that approximately the width of the inner portion of the package, and a length of about 16 cm. A forming block (not shown) having stamp face dimensions approximating those of the inner bottom face area of the package is used to push the foil into the box.

A backstop 1110 located at the front of the carriage 1086 assists in maintaining the package 1095 in place during operation of the apparatus 1051. On the top face of the backstop 1110 is positioned a slot 1115. The slot 1115 preferably is configured such that inner package wrapping paper or paper-lined foil (not shown) extending from the front bottom of the package 1095 can be fed into the slot 1115 in order that the foil is positioned out of the way when the cigarette package 1095 is filled with cigarettes.

Referring to FIGS. 2 and 3, the package-filling apparatus 1051 is shown with a cartridge 38 containing twenty cigarettes 13 appropriately positioned on the positioning region of the upper platform 1073. The carriage 1086 has been moved forward, such that the package 1095 carried thereby is positioned below the open center region 1079 beneath the cartridge. The device 1051 is configured such that the cartridge 38 can be slid on the upper surface of the upper platform 1058 towards the rear of the device. When the cartridge is moved rearward, each ejection rod 1067 remains still such that each rod passes through the openings 550 in the front surface of the cartridge 38 and resists the cigarettes' rearward motion by pushing against the rear face of each filter element of each respective cigarette. Effectively, as the cartridge 38 is moved rearward, each rod 1067 passes through the corresponding opening 550 in the front face of the cartridge 38, hence pushing the cigarettes 13 out of the cartridge. As such, cigarettes can be removed from the cartridge without the necessity of turning the cartridge over to dump cigarettes therefrom or of tipping the cartridge upwards so that cigarettes fall therefrom. The cigarettes 13 that are pushed from the cartridge 38 and fall through the open center region 1079. The cigarettes 13 consequently fall into, and fill, the open package 1095 that is positioned in the below the open center region 1079. An operator can use his/her finger to align the cigarettes within the package, but preferably the cigarettes are aligned without being touched, or are moved into alignment within the package using a tool (e.g., a nylon probe) that will not mar the cigarettes. The handle 1089 then can be used to move the carriage 1086 rearwards in order to expose the package filled with cigarettes. The filled package can be removed from the carriage and closed. A new empty package then can be inserted into the carriage. Meanwhile, the empty cartridge can be moved forward and removed from the device. A new cartridge filled with cigarettes can be placed into the device. As such, the package filling process can be repeated.

For a representative device for filling a cigarette package with manufactured cigarettes described with reference to FIG. 2 and FIG. 3, the device is configured to fill a package with twenty cigarettes. Suitable alterations to the apparatus and its components can be made to hold or transfer a greater or lesser number of cigarettes contained in a cartridge. For example, a package designed to contain ten cigarettes can be filled with the embodiment described with reference to FIG. 2 and FIG. 3 by loading ten cigarettes into the cartridge and using the device to fill that package.

As mentioned previously, the cigarette package 1095, such as, for example, a shoulder box, and associated wrapping materials can be embossed, printed with indicia, or the like, such as, for example indicia label 150 (FIG. 6), during the original manufacturing process for indicating the manufacturer, brand, flavor etc. of the cigarettes to be contained in the cigarette package 1095. However, such indicia may be typically pre-printed on the packaging and/or wrapping materials on the production line to indicate an as-formed condition, and customization thereof is not available on the production line. In other instances, the indicia may be imprinted on the packaging/wrapping on the production line, but such mechanisms (embossing, printing) used therefor are generally predetermined or otherwise set prior to production. As such, customization of the cigarette packages 1095 is typically not possible.

As such, FIG. 4 illustrates an apparatus for customizing a cigarette package, according to one aspect of the present invention, the cigarette package customization apparatus being generally indicated by the numeral 100. In one aspect, the apparatus 100 comprises a feeder unit 204 configured to feed a cigarette package 1095 to a register position 400. One skilled in the art will recognize that may types of cigarette packages may be implemented in accordance with embodiments of the present invention, even though the "shoulder box" is provided for illustrative purposes only. An imprinting unit 500 is configured to interact with the cigarette package 1095 in the register position 400 so as to selectively imprint at least one of an alphanumeric character and a graphical character (collectively indicated as element 600 as shown, for example, in FIG. 6, and otherwise referred to herein as "character 600" for brevity) thereon. The feeder unit 204 and/or the imprinting unit 500 may be controlled by a computer device 700 (as shown, for example, in FIG. 4) though, in some instances, each of the feeder unit 204 and the imprinting unit 500 may be controlled by a separate computer device. The imprinting unit 500 may be positioned along a production line for imprinting the as-formed cigarette packages 1095 before or after the cigarette package 1095 being filled with cigarettes by a cigarette packaging device. In other instances, the imprinting unit 500 may be remotely disposed from the production line such that the finished as-formed cigarette package 1095 is imprinted separately and offline therefrom.

As shown in FIG. 4, the feeder unit 204 is configured to feed a cigarette package 1095 to a register position 400. In some instances, the feeder unit 204 may be configured to select the cigarette package 1095 from a plurality of cigarette packages 1200. The plurality of cigarette packages 1200 may be disposed, for example, in a hopper 220 operably engaged with the feeder unit 204. The hopper 220 may be configured as a receptacle associated with the feeder unit 204, into which the plurality of cigarette packages 1200 may be manually or automatically fed. In some instances, the feeder unit 204 may include a separator mechanism 208 configured to interact with the cigarette package 1095 in such a manner that the plurality of cigarette packages 1200 are released sequentially from the hopper 220 into the feeder device 204 and such that an individual cigarette package 1095 can be fed to the register position 400. In one example, the plurality of cigarette packages 1200 may be vertically stacked in a vertically-extending hopper 220 oriented perpendicularly to the feeder device 204. In such instances, each cigarette package 1095 may be fed in the desired orientation to the feeder unit 204, which may comprise, for example, a conveyor device 206. The separator mechanism 208 may be operably engaged with or otherwise secured to the conveyor device 206 so as to move therewith. A cigarette package 1095 may be positioned onto the conveyor device 206 in registration with the separator mechanism 208 such that the cigarette package 1095 may be advanced toward the registration position 400 and imprinting device 500. One skilled in the art will appreciate, however, that the plurality of cigarette packages 1200 may be provided to the feeder device 204 in many different manners, either online or offline with respect to a cigarette making machine and/or a cigarette packaging machine, as required or otherwise desirable. As illustrated, each cigarette package 1095 advanced to the registration position 400 may have a cover portion 1102 disposed in a "face-up" orientation with respect to the conveyor device 206 such that the top cover 1102 can interact with the imprinting device 500 so as to allow the imprinting device 500 to form or provide the customized indicia thereon. One of ordinary skill in the art, however, will recognize that the cigarette receptacle portion 1098 may be disposed in a "face-up" orientation on the conveyor device 206 so as to be imprinted thereon.

Aspects of the feeder device 204, according to the present invention, may also be configured to initially separate an individual cigarette package 1095 from the plurality of cigarette packages 1200 in a direction substantially perpendicularly to the longitudinal axis of the conveyor device 206 (i.e., in association with the hopper 220). Once an individual cigarette package 1095 is separated from the plurality of cigarette packages 1200, the individual cigarette package 1095 can then be fed by the feeder device 204 to the register position 400 in a suitable manner. For example, as shown in FIG. 4, the individual cigarette package 1095 may be fed longitudinally, along the longitudinal axis of the conveyor device 206, to the register position 400 by the feeder device 204.

FIG. 4 illustrates the example of a feeder device 204 for handling a plurality of cigarette packages 1200 such as, for example, about 10 in number, deposited in a hopper 220, so as to feed one individual cigarette package 1095 at a time to the register position 400. The feeder device 204 may be assembled to a base structure (not shown) made from any suitable rigid material, such as aluminum sheet plate, and the hopper 220 is secured to the base structure and/or conveyor device 206 in a suitable manner. Each cigarette package 1095 may be transported vertically downward through the hopper 220 under the influence of gravity. That is, as the cigarette package 1095 is received at an initial position 402 on the conveyor device 206 from a vertical direction and is then horizontally advanced toward the registration position 400 via interaction with the separator mechanism 208, the cigarette package 1095 previously positioned thereabove descends onto the conveyor device 206 under the influence of gravity.

The conveyor device 206 is operably engaged with the hopper 220 such as, for instance, disposed beneath the hopper 220. In some instances, the release of the cigarette packages 1200 can be indexed onto the conveyor device 206 under control of, for example, the computer device 700. As a result, the interaction between the hopper 220 and the conveyor device 206 causes an individual cigarette package 1095 to be fed with respect to the separator mechanism 208 such that, as the conveyor device 206 continues to rotate when indexed, one of the cigarette packages 1095 is deposited onto the conveyor device 206.

A motor may be operably engaged with the feeder device 204 to drive, for example, the conveyor device 206 and may also be controlled by the computer device 700. When actuated by the computer device 700 (i.e., once an individual cigarette package 1095 is deposited from the hopper 220 onto the conveyor device 206), the motor causes the conveyor device 206 to advance. The separator mechanism 208 advances the cigarette package 1095 along the conveyor device 206 until the cigarette package 1095 reaches the register position 400. The advancement of cigarette packages 1095 by the separator mechanism 208 may be determined in many different manners such as, for example, by a suitable optical-, contact-, or proximity-type limit switch, sensor, or detector operably engaged with the feeder device 204 and/or the computer device 700. In some instances, the register position 400 may be defined past the advancement limit of the conveyor device 206 such that advancement of a subsequent cigarette package 1095 displaces the previously advanced cigarette package 1095. In the register position 400, at least a portion of the cigarette package 1095 is supported by a support member 1097 in a position adjacent to the conveyor device 206 such that the cigarette package 1095 is supported thereby while being imprinted by the imprinting device 500. Once the cigarette package 1095 is imprinted by the imprinting device 500, the conveyor device 206 continues to advance and deposits the imprinted cigarette package 1095 on, for example, a second conveyor device (not shown), which transports the imprinted cigarette package 1095 to an appropriate collection arrangement (not shown). In the alternative, the imprinted cigarette package 1095 may be transported by the conveyor device 206 directly to the collection arrangement.

The imprinting device 500 may be mounted to the feeder device 204 or, in another instance, the imprinting device 500 may be supported by a separate bracket (not shown). In any instance, the imprinting device 500 is appropriately supported with respect to the feeder device 204 to be capable of interacting with the cigarette package 1095 in the register position 400. For example, each of the feeder device 204 and the imprinting device 500 may include complementary alignment elements (not shown) capable of operably engaging each other. Once engaged, the alignment elements are configured to align the imprinting unit 500 with the feeder unit 204 such that the imprinting unit 500 interacts with the cigarette package 1095 in the register position 400. One skilled in the art will appreciate, however, that different arrangements may also be implemented to allow the imprinting device 500 to appropriately interact with the cigarette package 1095 in the register position 400. For example, a pattern-recognition unit (not shown) may be implemented in conjunction with a movable or otherwise adjustable imprinting unit 500, whereby such a pattern-recognition unit first locates the cigarette package 1095 and the imprinting site thereon, and then appropriately guides the imprinting unit 500 to interact with the cigarette package 1095 in the register position 400.

Once aligned with the cigarette package 1095 in the register position 400, the imprinting unit 500 may be further configured to interact with at least one of the cover portion 1102 and the cigarette receptacle portion 1098 of the cigarette package 1095, so as to selectively imprint at least one of an alphanumeric character and a graphical character 600 thereon as shown, for example, in FIG. 6. The imprinting procedure can be selectively controlled so as to allow for customization and/or personalization of one or more cigarette packages 1095. In some instances, the character 600 may be imprinted only on the cover portion 1102, only on the cigarette receptacle portion 1098, or on both cigarette package portions 1102, 1098. As such, the imprinting unit 500 may include a single laser imprinting unit capable of being controlled by the computer device 700 to provide imprinting of the character 600 on the cigarette package 1095. In other instances, however, the imprinting unit 500 may comprise a plurality of adjacent imprinting elements (i.e., laser imprinting units such as elements 500A, 500B, 500C in FIG. 5), wherein each imprinting element is substantially equidistantly-spaced from the surface of the cigarette package 1095 facing the imprinting units 500A, 500B, 500C. The computer device 700, in communication with and capable of controlling each imprinting element, may also be configured to selectively imprint a portion of the at least one of an alphanumeric character and a graphical character 600 on the cigarette package 1095, by selectively implementing (i.e., individually, sequentially, or simultaneously) the plurality of imprinting elements. Further, in some instances, the feeder unit 204 and/or conveyor device 206 may have a cigarette package rotation device 1096 operably engaged therewith. In such instances, the cigarette package rotation device 1096 may be configured to rotate and/or flip a cigarette package 1095, in the register position 400, so as to facilitate, for example, printing of the character 600 by a single imprinting element on the opposing surface and/or sides of the cigarette package 1095.

The at least one of an alphanumeric character and a graphical character 600 (or "character 600") may be formed by the imprinting unit 500 in many different selective manners within the scope of aspects of the present invention. For example, the character 600 may comprise, for example, a company logo, alphabetic letters, words, numbers, symbols, graphics, or combinations thereof, to form, for instance, a name, a phone number, an email address, a website address, a short quote, a logo, one or more symbols, or combinations thereof (see, e.g., FIG. 6). In some instances, the character 600 may also be combined with various shading, contrasting, underlining, bordering, other special effects, or combinations thereof. In order to imprint the character 600 on the as-formed cigarette package 1095, the imprinting device 500 is configured to be responsive to the computer device 700 such that the character 600 selected by a user and input into the computer device 700 wherein the character 600 is then selectively transferred to the cigarette package 1095, when the cigarette package 1095 is in the register position 400. In one instance, the imprinting device 500 may comprise a laser imprinting device such as, for example, a VersaLaser (VLS2.30 or Value Laser Series) Laser Marking System, or other suitable model and/or series of imprinting device. In one particular instance, the imprinting device 500 may employ a laser operating at approximately 300 watts. The computer device 700 operably engaged therewith may comprise, for example, a laser controller PC executing operating software, and communicating with the imprinting device 500 via an appropriate interface.

In basic operation, the plurality of cigarette packages 1200 is first loaded into the hopper 220 by manual loading or via a feeder line disposed so as to feed the plurality of cigarette packages 1200 into the hopper 220. At the computer device 700, the desired message (i.e., character string) is entered via the operating software, wherein the message may be represented by, for example, a text message and/or a monochrome bitmap image. The bitmap image may be generated on another computer device and then imported into the operating software, or the bitmap image may be created via the operating software itself. The message may then be aligned, formatted, and appropriately sized with respect to the portion of the cigarette package 1095 on which the message is to be imprinted. More particularly, the operating parameters for the laser head are entered via the operating software, controlling such parameters as mark speed in bits per millisecond and "Laser-On-$CO_2$" to vary the intensity of the laser burn on the cigarette package 1095 (which also varies the "depth" of the laser burn with respect to the paper material comprising the cigarette package 1095). Such parameters may be adjusted, for instance, depending on the various components of the cigarette package 1095 on which the character 600 is imprinted.

Once the message and operating parameters have been input into the computer device 700, the parameters of the cigarette package are also entered via an operator interface executed on or otherwise associated with the computer device 700, wherein such parameters may vary depending on, for example, the length and width of the cigarette package 1095. The operator interface controls, for example, the operation of the feeder device 204, previously discussed, for receiving a cigarette package 1095 from the hopper 220 and then feeding that cigarette package 1095 to the register position 400 for interaction with the imprinting device 500.

In operation, the separator mechanism 208 maintains the cigarette package 1095 in the register position 400 while the cigarette package 1095 is imprinted by the imprinting device 500. As shown in FIG. 4, after a first cigarette package 1095A is imprinted, the computer device 700, via the executed software, directs the feeder device 204 to feed a second cigarette package 1095B to the register position 400. In doing so, the second cigarette package 1095B advanced by the separator mechanism 208 replaces the first cigarette package 1095A in the register position 400 for imprinting thereon by the imprinting device 500. The replaced imprinted cigarette package 1095A may be collected, for example, by a collector device operably engaged with or otherwise disposed adjacent to the conveyor device 206. This successive replacement process may be selectively continued for any number of cigarette packages 1095 from the hopper 220 or, in other instances, may be allowed to continue until the plurality of cigarette packages 1200 in the hopper 220 is depleted. In such instances, once the plurality of cigarette packages 1200 is depleted from the hopper 220 or otherwise from any feeder line, operation of the feeder device 204 and the imprinting device 500 is halted or placed in a stand-by mode, pending deposition of additional cigarette packages 1095 in the hopper 220. In some instances, the apparatus 100 may include a counting device (not shown) configured to count, and provide an indicia of the count, of the total number of cigarette packages 1095 imprinted by the imprinting device 500.

In some configurations, the apparatus 100 may be capable of imprinting, for example, about 20 cigarette packages per minute. However, one skilled in the art will appreciate that the apparatus 100 may be readily modified to provide faster or slower processing speeds by, for example, changing the advancement parameters of the feeder device 204. In this regard, the character 600 imprinted on the cigarette package 1095 may be affected by various parameters associated with the operation of the apparatus 100. For example, print resolution may be controlled by:

a) Character width and height: For a single line of print, a character dimension of about 3 mm wide and about 4 mm high may be required. For two lines of print, a character dimension of about 1.5 mm wide and about 2.5 mm high may be required. For three lines of print, a character dimension of about 1.5 mm wide and about 2.0 mm high may be required.

b) Character font and weight: Representative fonts include 3-LS Arial, 2-LS Arial, Comic Sans MS, Times New Roman, or any other suitable font.

c) Character weight may be controlled by the use of the bold print selection. Adjustments may also be made in the laser power and laser beam duration settings, and such parameters may also affect the appearance of the printed character.

The number of characters 600 that may be included on each line of message may be controlled, for example, by:

d) The dimension of the portion of the cigarette package 1095 being imprinted. For instance, the length or width of the cigarette package 1095 may be the limiting factor.

e) The particular font and character weight used for the customization. As the values of such parameters increase, the total number of characters 600 capable of being used decreases.

In any instance, the customized message may include any number of lines on the cigarette package 1095 (see, e.g., FIG. 6) imprinted thereon, as the cigarette package 1095 is stationarily maintained in register position 400 during the imprinting process, wherein the message may extend along the longitudinal axis of the cigarette package 1095, perpendicularly to the longitudinal axis, or otherwise angularly with respect to the longitudinal axis. However, if the feeder device 204 is configured to rotate (or flip) the cigarette package 1095 during the imprinting process and/or if the imprinting device 500 is configured to imprint about the sides of the cigarette package 1095, more lines may be imprinted. In any instance, one aspect involves determining appropriate imprinting parameters such that the character is of sufficient clarity so as to not appear "washed out" or faded after the imprinting process. Further, the characters 600 are generally imprinted on the cigarette package 1095 so as not to interfere (i.e., location-wise) with other labeling (e.g., label 150) pre-printed thereon or, alternatively, to be added at a later time.

In instances of cigarette packages 1095 already including a color indicia, the laser imprinting device 500 may be configured to partially "burn" the packaging material, or a layer of the packaging material (if the packaging material includes multiple layers), so as to imprint the selected character 600 with suitable contrast with respect to the packaging material, but without burning therethrough. The contrast provided by the interaction between the laser imprinting device 500 and the packaging material allows the character to be visible/legible and facilitates customization/personalization of the cigarette package 1095. For example, interaction of the laser imprinting device 500 with a white packaging material may produce a brown-colored contrasting character 600, while interaction with a "brown" packaging material may produce a white-colored contrasting character. In some instances, the operational parameters of the laser imprinting device 500 may also be varied, in cooperation with the packaging material, to provide a different contrasting color of the imprinted character 600.

According to one aspect, implementing an imprinting device 500 as previously discussed herein, variations in particular parameters may cause the laser imprinting device 500 to either "burn" too lightly, such that an unsatisfactory character 600 is provided, or to "burn" too heavily, so as to burn through the wrapping material. Parameters such as "mark-speed" and "laser on $CO_2$" may be important in this regard. In one embodiment, the parameters of the laser imprinting device 500 may be selected so as to provide a balance, for example, between the depth/extent of the "burn" provided by the laser imprinting device, versus the contrast achieved with respect to the imprinted character 600, but without affecting the structural integrity of the cigarette package 1095. One skilled in the art will appreciate, however, that such parameters may change considerably depending on particular conditions encountered in any given cigarette package customization process.

One skilled in the art will further appreciate that the customization/personalization process discussed herein may occur in a number of different manners. For example, such customization/personalization may occur at the cigarette making plant, factory, or laboratory. That is, customized/personalized cigarette packages could be created onsite at the factory (i.e., cigarette packages are engaged with the apparatus 100, which processes (imprints) the cigarette packages, which, at this point, may or may not include as-formed cigarettes, and then directs the imprinted cigarette packages to a collection device for collection and packaging) for promotions, special offers, and/or customized sales. In other instances, a portable apparatus 100 may allow such customization/personalization to be implemented in an aftermarket setting outside the factory or lab environment. For example, a portable apparatus 100 could be implemented at "brand" events. That is, previously-packaged cigarettes could be provided by a customer or retailer, wherein the cigarette packages are unwrapped (and, in some instances, emptied, such that the as-formed cigarettes therein may be separately customized by selectively imprinting an alphanumeric character and/or a graphical character thereon using a cigarette imprinting unit; see, e.g., U.S. Patent Publication No. 2008/0202540 to Carter et al. (for customized cigarette), the disclosure of which is incorporated herein by reference) and loaded into the hopper of the apparatus 100, and whereby the apparatus 100 is configured to process (imprint) the cigarette packages and, in instances where the cigarettes are separately customized, re-package the imprinted as-formed cigarettes within the cigarette package using a re-packaging unit (e.g., package-filling device 1051), wherein the imprinted cigarette packages may then be directed to a collection device for collection and rewrapping. Thus, in some embodiments, both the cigarette package and the cigarettes packaged therein may be customized/personalized.

In one alternative, the portable apparatus 100 could be implemented at cigarette stores (i.e., a retailer produces customized/personalized cigarette packages at the request of a customer at point-of-sale, wherein the cigarette packages are unwrapped and loaded into the hopper of the apparatus 100, and whereby the apparatus 100 is configured to process (imprint) the cigarette packages and direct the imprinted cigarette packages to a collection device for collection and rewrapping/repackaging) so as to instantly provide customized/personalized cigarette packages for adult smokers. Such customization/personalization could be accomplished selectively (i.e., a chosen number of cigarette packages), in bulk (i.e., a batch of cigarette packages), or on a per pack or a per carton basis. In other instances, the apparatus 100 could be configured for selective operation by a consumer at a point-of-sale (i.e., the apparatus 100 could be provided in or as a "kiosk," where the purchaser of cigarettes could choose to customize the cigarette package of a purchased pack on a self-serve basis).

In some instances, a cigarette making device may be incorporated within a tobacco specialty retail shop or store. That is, at least one such device may be on prominent display within the premises of a retail establishment specializing in high quality or premium tobacco products. Such a shop or store may have a name that corresponds to the brand name of tobacco products available for sale within that shop or store. For example, such a cigarette-making device can be employed to manufacture cigarettes for commercial sale in a tobacco retail outlet such as the establishment which operated as Marshall McGearty Tobacco Lounge at 1553 N. Milwaukee Avenue, Chicago, Ill. The shop or store preferably includes an inviting atmosphere, comfortable lounge areas or appropriate places to sit and enjoy the smoking of tobacco products, a high quality air handling or air conditioning system, and locations to purchase tobacco products. A customer within such a shop or store can talk with a tobacconist about the cigarettes that are manufactured in that retail establishment. The packaging, filter materials, cigarette paper materials, tobacco components (including the selection of tobacco types and grade, tobacco blends, and casing and top dressing components) can be high quality in terms of sensory properties and appearance. Locating a cigarette making device within such a shop or store allows the customer within such an establishment to experience the manufacture of cigarettes, and enjoy cigarettes that are freshly made in his/her presence. For example, that customer can smell the aroma of different tobaccos within the store, and can view the manufacture of cigarettes expressly for him/her. As one example, a customer may have chosen between tobacco blends such as those incorporated into Marshall McGearty brand styles identified as The Standard, Karmelita, Oriental Rose, Malawi Kings, Cutlass, Samsun Straights, Virginia, Four Corners, The Empress, The Earl, North Star, Aegean, and Muse. The selected blend (s) may then have been manufactured into cigarettes by Marshall McGearty Tobacco Artisans using the cigarette making device. In this environment, using multi-sensory inputs (e.g., sight, smell), the customer can make an informed decision on his/her selection of different tobaccos and/or tobacco blends to be loaded into a cigarette making device to manufacture cigarettes in his/her presence. Thus, embodiments of a cigarette package customization apparatus 100 according to the present invention may also be utilized in such a retail setting that provides a customer with an aesthetic experience and an individually selected product, such that the customer may also obtain customized packaging for the custom cigarettes selected thereby. In such instances, the customer may also be provided with customized as-formed cigarettes. Such customized as-formed cigarettes may be provided using an apparatus such as that disclosed in U.S. Patent Publication No. 2008/0202540 to Carter et al., incorporated herein by reference in its entirety.

In any instance, cigarette packages imprinted according to embodiments of the present invention may also be randomly distributed, or be packaged in a carton with non-imprinted cigarette packages. For example, the imprinted cigarette package could be combined with other cigarette packages, which are not imprinted. In such a manner, the imprinted cigarette package may be used, for example, for purposes of a contest (i.e., the holder of a carton of cigarettes having an imprinted cigarette package therein may be the winner of a prize), or in any other manner where the presence of an imprinted cigarette package may distinguish the holder thereof.

Many modifications and other aspects of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. An apparatus for customizing an as-formed cigarette package configured to receive a plurality of as-formed cigarettes therein, the apparatus comprising:

a feeder unit configured to serially feed a plurality of as-formed cigarette packages along a feed direction to a stationary register position on a support member adjacent to a conveyor device; and, an imprinting unit configured to interact with a single cigarette package in the stationary register position at a time so as to selectively and directly imprint at least one of an alphanumeric character and a graphical character thereon, wherein the feeder unit is further configured such that a second single, as-formed cigarette package fed by the feeder unit toward the stationary register position displaces a first single, as-formed cigarette package disposed in the stationary register position, following imprinting of the first single, as-formed cigarette package by the imprinting unit.

2. An apparatus according to claim 1 further comprising a hopper operably engaged with the feeder unit, the hopper being configured to receive the plurality of as-formed cigarette packages and to provide the as-formed cigarette packages to the feeder unit.

3. An apparatus according to claim 1 further comprising a rotational device configured to rotate the as-formed cigarette package, in the stationary register position, about a major axis thereof.

4. An apparatus according to claim 1 wherein the as-formed cigarette package comprises a cigarette receptacle portion having a cover portion associated therewith, and the imprinting unit is adapted to interact with at least one of the cigarette receptacle portion and the cover portion of the as-formed cigarette package, when the as-formed cigarette package is in the stationary register position, so as to selectively and directly imprint the at least one of an alphanumeric character and a graphical character thereon.

5. An apparatus according to claim 1 further comprising a collector device operably engaged with the feeder unit and configured to collect the as-formed cigarette packages after imprinting thereof by the imprinting unit.

6. An apparatus according to claim 1 wherein the imprinting unit further comprises a laser imprinting device.

7. An apparatus according to claim 1 wherein the imprinting unit further comprises a plurality of spaced-apart imprinting elements, each imprinting element being equidistantly-spaced from a surface of the as-formed cigarette package facing the imprinting unit, and being configured to selectively and directly imprint a portion of the at least one of an alphanumeric character and a graphical character on the surface of the as-formed cigarette package facing the imprinting unit.

8. An apparatus according to claim 1 wherein the feeder unit and the imprinting unit each further include complementary alignment elements capable of cooperating to align the imprinting unit with the feeder unit such that the imprinting unit interacts with the as-formed cigarette package in the stationary register position.

9. An apparatus according to claim 1 further comprising a packaging unit configured to package a selected number of cigarettes into the as-formed cigarette package after imprinting thereof by the imprinting unit.

10. An apparatus according to claim 1 further comprising a cigarette imprinting unit configured to receive the as-formed cigarettes and to selectively imprint at least one of an alphanumeric character and a graphical character thereon.

11. An apparatus according to claim 10 further comprising a cigarette re-packaging unit configured to re-package the imprinted as-formed cigarette within the imprinted as-formed cigarette package.

12. A method of customizing an as-formed cigarette package configured to receive a plurality of as-formed cigarettes therein, the method comprising:

serially feeding a plurality of as-formed cigarette packages along a feed direction of a feeder unit to a stationary register position on a support member adjacent to a conveyor device, selectively and directly imprinting at least one of an alphanumeric character and a graphical character on a single, as-formed cigarette package in the stationary register position using an imprinting unit, and displacing a first single, as-formed cigarette package disposed in the stationary register position, following imprinting thereof by the imprinting unit, with a second single, as-formed cigarette package fed by the feeder unit toward the stationary register position.

13. A method according to claim 12 further comprising receiving the plurality of as-formed cigarette packages in a hopper operably engaged with the feeding unit and providing the as-formed cigarette packages therefrom to the feeder unit.

14. A method according to claim 12 further comprising rotating the as-formed cigarette package, in the stationary register position, about a major axis thereof.

15. A method according to claim 12 wherein the as-formed cigarette package comprises a cigarette receptacle portion having a cover portion associated therewith, and selectively and directly imprinting at least one of the alphanumeric character and the graphical character further comprises selectively and directly imprinting at least one of the alphanumeric character and the graphical character on at least one of the cigarette receptacle portion and the cover portion of the as-formed cigarette package, when the as-formed cigarette package is in the stationary register position.

16. A method according to claim 12 further comprising collecting the as-formed cigarette packages, after imprinting thereof by the imprinting unit, with a collector device operably engaged with the feeder unit.

17. A method according to claim 12 wherein selectively and directly imprinting at least one of the alphanumeric character and the graphical character further comprises selectively and directly imprinting at least one of the alphanumeric character and the graphical character using a laser imprinting device.

18. A method according to claim 12 wherein the imprinting unit further comprises a plurality of spaced-apart imprinting elements, with each imprinting element being equidistantly-spaced from a surface of the as-formed cigarette package facing the imprinting unit, and wherein selectively and directly imprinting at least one of the alphanumeric character and the graphical character further comprises selectively and directly imprinting a portion of the at least one of the alphanumeric character and the graphical character on the surface of the as-formed cigarette package facing the imprinting unit with one of the imprinting elements.

19. A method according to claim 12 wherein the feeder unit and the imprinting unit further include complementary alignment elements, and the method further comprises operably engaging the alignment elements so as to align the imprinting unit with the feeder unit such that the imprinting unit interacts with the as-formed cigarette package in the stationary register position.

20. A method according to claim 12 further comprising packaging a selected number of cigarettes into the as-formed cigarette package, after imprinting thereof by the imprinting unit, using a packaging unit.

21. A method according to claim 12 further comprising:

selectively and directly imprinting at least one of an alphanumeric character and a graphical character on the as-formed cigarette using a cigarette imprinting unit; and re-packaging the imprinted as-formed cigarettes within the imprinted as-formed cigarette package with a cigarette re-packaging unit.

* * * * *

UNITED STATES PATENT AND TRADEMARK OFFICE

CERTIFICATE OF CORRECTION

PATENT NO. : 8,522,515 B2
APPLICATION NO. : 12/359843
DATED : September 3, 2013
INVENTOR(S) : Carter et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 722 days.

Signed and Sealed this
Twenty-second Day of April, 2014

Michelle K. Lee

Michelle K. Lee
*Deputy Director of the United States Patent and Trademark Office*